US006971353B2

(12) United States Patent
Heinze et al.

(10) Patent No.: US 6,971,353 B2
(45) Date of Patent: Dec. 6, 2005

(54) CAMSHAFT ADJUSTMENT CONTROL DEVICE

(75) Inventors: Matthias Heinze, Berlin (DE); Kai Lehmann, Ludwigsfelde (DE); Jens-Uwe Plank, Berlin (DE); Jörg Rösener, Berlin (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/897,988

(22) Filed: Jul. 23, 2004

(65) Prior Publication Data

US 2005/0103294 A1 May 19, 2005

(30) Foreign Application Priority Data

Jul. 24, 2003 (DE) ..... 103 33 604

(51) Int. Cl.[7] ..... F01L 1/34
(52) U.S. Cl. ..... 123/90.17; 123/90.15; 123/90.31
(58) Field of Search ..... 123/90.17, 90.15, 123/90.31

(56) References Cited

U.S. PATENT DOCUMENTS 6,363,896 B1 * 4/2002 Speier ..... 123/90.17
6,460,559 B2 * 10/2002 Smith et al. ..... 137/15.22
6,481,402 B1 * 11/2002 Simpson et al. ..... 123/90.17
6,810,843 B2 * 11/2004 Quinn, Jr. ..... 123/90.15
2002/0088417 A1 * 7/2002 Palesch et al. ..... 123/90.17

FOREIGN PATENT DOCUMENTS

DE 198 17 319 10/1999
DE 199 30 711 8/2000

* cited by examiner

*Primary Examiner*—Thomas Denion
*Assistant Examiner*—Zelalem Eshete
(74) *Attorney, Agent, or Firm*—Klaus J. Bach

(57) ABSTRACT

In a camshaft adjustment control device for an internal combustion engine arranged in the drive train for a camshaft, with an inner body connected to the camshaft and an outer body rotatable relative to the inner body, and a control space between the inner and the outer bodies to which hydraulic fluid can be supplied for adjusting the relative angular positions of the inner body connected to the camshaft and the outer body driven by the crankshaft, the inner body is mounted to the camshaft by a bolt having a central bore in which a control spool valve is disposed controlling the flow of fluid to and from the control space and a check valve is arranged in the supply lines of the hydraulic fluid to the control spool valve which check valve opens when a certain pressure is applied thereto.

7 Claims, 2 Drawing Sheets

CAMSHAFT ADJUSTMENT CONTROL DEVICE

BACKGROUND OF THE INVENTION

The invention relates to a camshaft adjustment device for internal combustion engines which is disposed in the drive train for a camshaft between the crankshaft and the camshaft and is disposed coaxially with the camshaft. The device includes an inner body which is firmly connected to the camshaft for rotation therewith by a co-axial clamping bolt, an outer body which is rotatable with respect to the inner body, and which is connected to the crankshaft indirectly or directly so as to be driven thereby. Between the inner and the outer bodies a space is provided for hydraulic control means for adjusting the angular position of the outer body relative to the inner body. An associated control device with a control valve is integrated into the clamping bolt which includes an axial cavity for an axially movable spool control valve.

An arrangement is already known (DE 199 30 711 C1) which includes an inner part provided with blades or wings for changing the relative rotational positions of the camshaft of an internal combustion engine relative to the drive wheel thereof wherein the inner part is rotationally movably supported in a cell wheel. This driven cell wheel includes several webs distributed circumferentially which are divided by webs or wings of the inner part in each case into two pressure chambers. By applying pressure to, or releasing pressure from, the pressure chambers the angular position of the camshaft relative to the crankshaft can be changed.

In the hub of the interior part, there is a check valve which can be hydraulically controlled and which, in its closed position, blocks the release of fluids from a group of pressure chambers in addition to the remotely arranged control valve. However, this check valve is arranged behind the 4/3 passage valve and needs to be switched therefore. That is, depending on an adjustment the blocking must occur in one or the other direction.

Furthermore, DE 198 17 319 A1 discloses a camshaft adjustment control device for internal combustion engines which is arranged in the drive arrangement for the camshaft by the camshaft with an inner rotational body which is mounted on the camshaft for rotation therewith by a coaxial clamping bolt, an outer body, which is rotatable relative to the inner body and which is connected to the crankshaft so as to be directly or indirectly driven thereby, a space between the inner body and the outer body for receiving a hydraulic operating fluid for a position-adjustment of the outer body relative to the inner body, and a control device with a multi-way valve which is integrated into the clamping bolt which has a cavity for receiving the axially movable control valve.

It is the object of the present invention to provide an oil supply arrangement for a camshaft adjustment control device for internal combustion engines in such a way that the camshaft adjustment control device can be made very compact and lightweight and is also relatively inexpensive to manufacture.

SUMMARY OF THE INVENTION

In a camshaft adjustment control device for an internal combustion engine arranged in the drive train for a camshaft, with an inner body connected to the camshaft and an outer body rotatable relative to the inner body, and a control space between the inner and the outer bodies to which hydraulic fluid can be supplied for adjusting the relative angular positions of the inner body connected to the camshaft and the outer body driven by the crankshaft, the inner body is mounted to the camshaft by a bolt having a central bore in which a control spool valve is disposed controlling the flow of fluid to and from the control space and a check valve is arranged in the supply lines of the hydraulic fluid to the control spool valve which check valve opens when a certain pressure is applied thereto.

With the integration of the check valve into the hydraulic system of the camshaft adjustment device the energy required for the adjustment, particularly the oil pressure and also the volumetric flow, can be reduced. With the smaller specific moment and the resulting reduction of the size, the pivot range between the inner and the outer bodies can be increased. In addition, the adjustment speed of the rotating camshaft control device is increased thereby. Also, the camshaft bearings are protected by the check valve from pressure peaks from the camshaft adjustment device. With the position of the check valve in close proximity to the control spool valve, a high hydraulic rigidity and small leakages in the system are achieved. The high hydraulic rigidity is achieved on one hand by the small leakages and, on the other hand, by a small dead volume which otherwise would be formed by the conduits and passages between the pressure chamber of the camshaft and adjustment device and the check valve. Altogether, the camshaft adjustment device can be relatively small while providing for an improved functionality and forms a very compact unit.

It is advantageous if the check valve is provided in a pressurized fluid passage extending through the inner body. With this advantageous placement of the check valve in the camshaft adjustment device the varying moments of the camshaft can be better utilized for the adjustment in that during the phase in which the non-uniform camshaft moment is lower than the respective hydraulically generated holding moment of the camshaft adjustment device, the camshaft adjustment device can advance the camshaft position against the effective direction of the camshaft moment. During the phase in which the non-uniform camshaft moment is higher than the respective hydraulically generated holding moment of the camshaft adjustment device, the check valve prevents the camshaft from being turned back by the counteracting camshaft moment. In this way, the adjustment speed becomes also to a certain degree independent of the oil pressure of the engine. The camshaft adjustment device pumps itself into the desired direction. The camshaft adjustment device quasi pumped in the desired direction.

In accordance with the particular embodiment, the check valve may be provided in a pressure fluid line, or respectively, in a bore which extends coaxially with the control spool valve for supplying pressurized fluid to the control spool valve. In this way, the return flow of fluid from the pressure area of the camshaft adjustment device by way of the central spool valve to the pressurized fluid supply can be interrupted by the check valve in a simple manner.

It is furthermore advantageous if the check valve is arranged in a pressure fluid line of the camshaft.

It is also advantageous in this connection if the central pressurized fluid line of the camshaft is in communication, by way of the check valve in the pressure fluid line in the camshaft, with an operating chamber of the camshaft adjustment device.

In a preferred embodiment of the invention, the pressurized fluid line for supplying fluid to the chambers between the inner body and the outer body and for the accommodation of the check valve extends in axially parallel relationship to a center axis of the control spool valve.

It is particularly important for the present invention that the clamping bolt which receives the spool valve is provided with a pressure fluid bore which extends co-axially with the center axis of the spool valve for supplying pressurized fluid to the blade structure and which includes the check valve.

In connection with the arrangement according to the invention, it is advantageous if the check valve includes a blocking member which consists of steel or of a ceramic material.

Preferably, the camshaft adjustment device includes a movement-supporting spring which provides for a return movement of at least 1 Nm. With the advantageous placement of the check valve in or at the hydraulic system of the camshaft adjustment device, the lengths of the conduits between the operating chamber of the adjustment device and the check valve can be very small. As a result, there are fewer leakage points in the area between the pressurized operating chamber and the non-pressurized operating chamber. In this way, it is also ensured that the check valve is arranged close to the pressurized fluid inlet of the central control valve.

Further details and advantages of the invention will become apparent from the following description thereof on the basis of the accompanying drawings.

DESCRIPTION OF PREFERRED EMBODIMENTS

Figure 1:
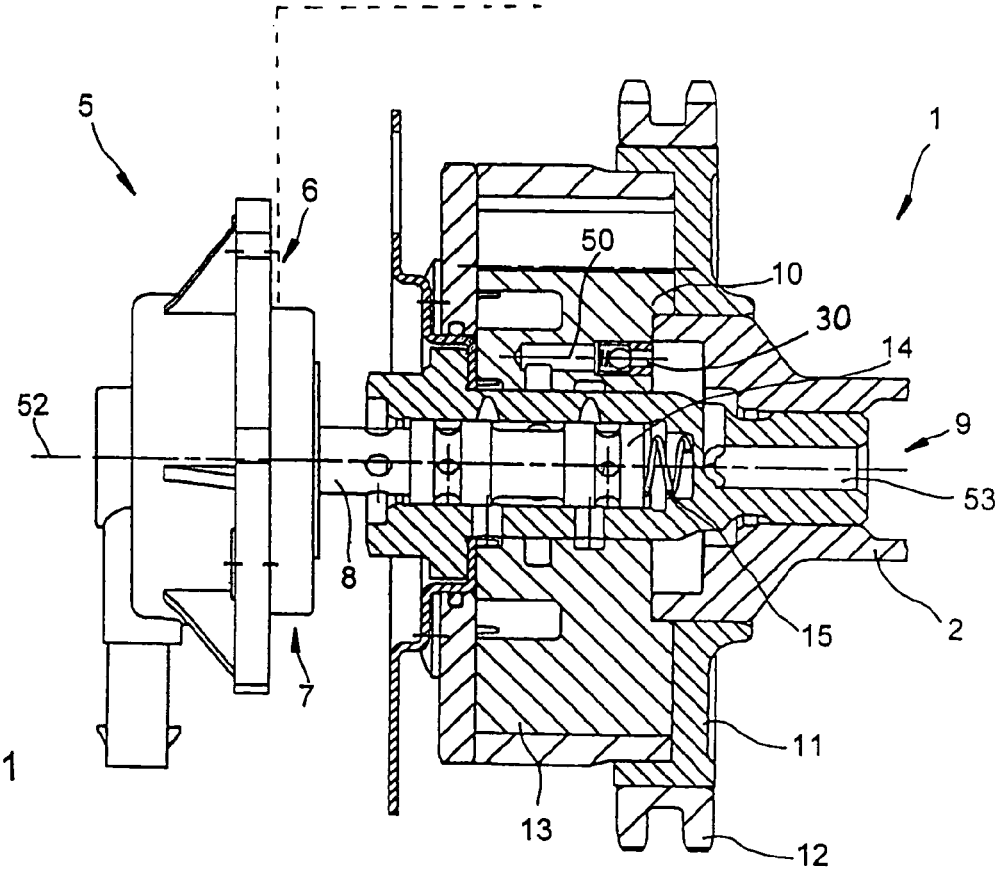
FIG. 1 is a cross-sectional view of a camshaft adjustment device with a check valve arranged in a pressurized fluid passage for supplying pressurized fluid to a blade body which is operatively connected to an outer body of the adjustment device.

FIG. 1 shows a camshaft adjustment device 1, which is mounted onto a camshaft 2 of an internal combustion engine, which is not shown in the drawings. As shown in FIG. 1 at the left end of the camshaft adjustment device 1, a chain housing surrounds the camshaft adjustment device 1 and is indicated in FIG. 1 by a dashed line. It is attached to an adjustment controller 5 by several screws 6. The adjustment controller 5 includes an operating magnet which is not shown and an armature 7. The armature 7 of the operating magnet acts on the valve spool 8 for positioning the spool 8 by force equilibrium adjustment with the spring 15 at the opposite end of the spool 8. The control spool 8 is integrated into a central bolt 9 and forms, together with the spring 15, a multi-way valve 3 wherein the central bolt 9 forms a clamping bolt by way of which the camshaft adjustment device 1 is mounted to the front end of the camshaft 2 (drive end of the camshaft). The clamping bolt 9 with the spool 8 of the camshaft adjustment device 1 and the controller 5 are all arranged co-axially with the camshaft 2.

The camshaft adjustment device 1 comprises an inner body 10, which is supported on the clamping bolt 9 and engaged thereby with the camshaft 2 and an outer body 11 disposed around the inner body. The outer body 11 is provided at its circumference with a gear structure 12 by way of which the camshaft 2 is drivingly connected via a drive chain to a crankshaft of the internal combustion engine, which is not shown in the drawings. In place of the chain drive as indicated herein other drive arrangements may be provided such as a toothed belt drive, or a gear drive.

The outer body 11 comprises a number of radial piston blades 13 arranged equally or irregularly spaced over the circumference and the inner body 10 is provided with counter blades extending radially into the spaces between adjacent piston blades 13 of the outer body 11. The outer body forms with its piston blades 13, a rotor, which is rotatable relative to the inner body 10 over a certain angular range delimited by the blades of the inner body 10.

Such arrangements are known in the art and described for example in DE 198 17 319 A1, column 4, line 10 to column 6, line 29 or in U.S. Pat. No. 6,523,513.

Figure 2:
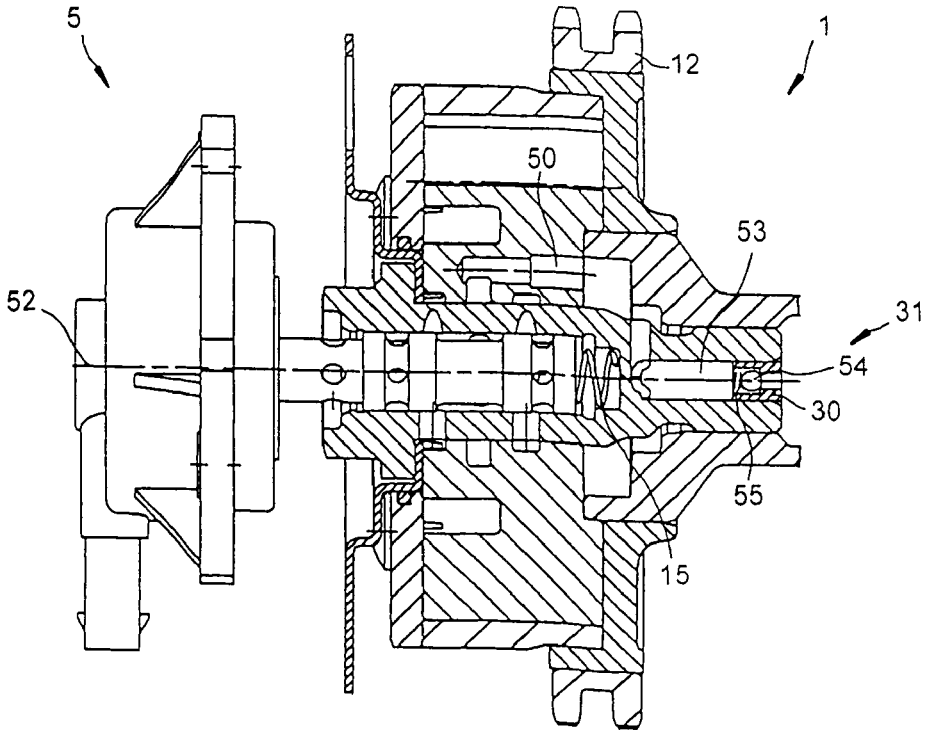
FIG. 2 shows another embodiment of a camshaft adjustment device with a check valve in a bolt shaft.
Figure 3:
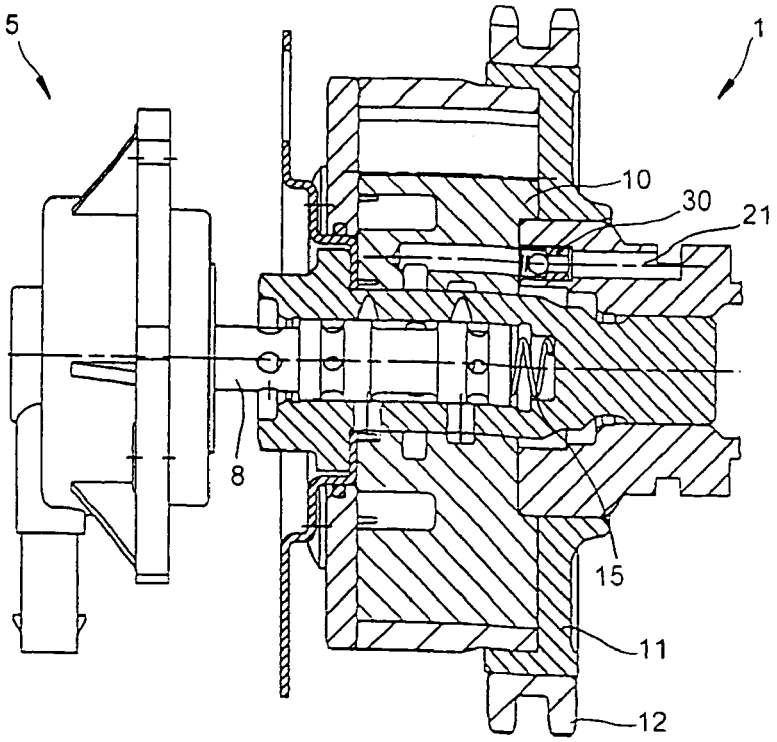
FIG. 3 shows a third embodiment of a camshaft adjustment device with a check valve in a pressurized fluid passage of the camshaft.

Within the respective ring sector, the piston blades 13 and the counter blades delimit operating chambers to which hydraulic fluid can be supplied or from which hydraulic fluid can be discharged under the control of the spool valve 8. The valve spool 8 is axially movably disposed in a bore 14 formed centrally in the center bolt or clamping bolt 9 and adjustable therein against the force of a spring 15. As shown in FIGS. 1–3, the spring 15 abuts the right end of the control spool 8 and the end wall of the axial bore 14 and extends coaxially with the control spool 8. The spring 15 is so selected that, with the adjustable force of the armature 7, the control spool 8 is held at a certain position between the stops of the spool 8.

Pressurized fluid is supplied to the chambers of the camshaft 2 in accordance with the embodiments of FIGS. 1 and 3 by way of a central fluid supply bore 53, which is disposed in the central bolt, that is the clamping bolt 9, co-axially with the center axis 52 of the control spool 8 and which is in communication with the operating chambers of the camshaft adjustment device by way of pressurized fluid passages which are not shown in the drawings.

As shown in FIG. 2, a check valve 30 is arranged in the central bore 53 and is integrated into the bore 53 between a connection 31 for permitting the admission of the hydraulic fluid and the hydraulic supply passages for the camshaft adjustment device 1 but preventing backflow of the hydraulic fluid. The check valve 30 may include a blocking member of steel or respectively high-grade stainless steel or of a ceramic material which is movable against the force of a spring 55 so that a passage through the valve 30 is opened at a correspondingly adjusted setting of the spring.

In accordance with FIG. 1, the check valve 30 may also be arranged in a pressurized fluid passage 50 in the inner body 10 or the piston blade 13 downstream of the pressurized fluid supply bore 53 wherein the pressurized fluid passage 50 extends preferably parallel to the longitudinal center axis 52 of the central bore 53.

It is furthermore possible in accordance with FIG. 3 to provide the check valve 30 in a bore or pressurized fluid passage 21 of the camshaft 2 by way of which pressurized fluid is supplied to the camshaft 2. With all three embodiments, the check valve 30 opens in the flow direction of the pressurized fluid supply to the camshaft adjustment device 1.

In accordance with FIG. 4, the check valve 30' may be particularly compact, if it consists of a valve seat sleeve 56, which is pressed into the central fluid supply passage 53' and a preferably ball-like blocking member 54 so as to form an integral part of the central fluid passage 53'. FIG. 5 shows the check valve 30' in an open position integrated into the shaft of the multi-way valve 3. FIG. 6 shows the valve 30' of FIG. 5 in a closed position.

The particularly compact design is obtained in that the check valve 30' does not include its own valve housing but is integrated into the control fluid supply passage or bore 53' utilizing the delimiting wall sections 57 to form the valve housing. The axial stroke limit for the blocking element 54 in the opening direction 58 can be formed for example by a suitable end wall of the central bore 53' in the multi-way valve 3. The blocking element 54 is operated only by the pressure differences effective at the connections and the resulting volume flow. No spring biasing the blocking element into the closed position is necessary.

Since, in the shown example, the blocking element 54 is guided directly by the surface of the bore of the multi-way valve 3 and does not require an additional guide sleeve or a corresponding valve housing the usually very limited radial space can be utilized to provide a relatively large flow cross-section which has a low flow resistance such that hydraulic losses are minimized and the cam adjustment speed is maximized.

For a small axial construction space without changing the oil supply line, which normally does not include a check valve 30', the preferably spherical blocking element 54 may be subjected in closing direction radially to the fluid.

Furthermore, with the short axial length of the check valve 30', it is possible for the spherical blocking element 54 when subjected to radial flow in the closing direction 59 to integrate the check valve 30' into a pressurized fluid line 50' in the inner body 10 or respectively in the piston vane 13. In this case, it is particularly advantageous if two or more check valves 30' are provided in a parallel flow arrangement whereby larger flow volumes and higher adjustment speeds can be achieved.

For a long life of the adjustment control device 1 one or both of the check valve components (blocking element 54 and, respectively, valve seat sleeve 56) consist of a material with a high wear resistance.

What is claimed is:

1. A camshaft adjustment control device (1) for an internal combustion engine arranged in the drive train for a camshaft (2) from a crankshaft and mounted coaxially onto the camshaft (2) for rotation therewith, said camshaft adjustment control device (1) comprising an inner body (10) connected to the camshaft (2) by a co-axial clamping bolt (9), an outer body (11) extending around the inner body and being rotatable relative to the inner body (10) and operatively connected to the crankshaft so as to be driven thereby, said inner and outer bodies (10, 11) defining therebetween a control space to which, a hydraulic fluid can be supplied for adjusting the angular position of the inner and outer bodies (10, 11) relative to each other, a control valve including a control spool (8) movably supported in a central bore in the clamping bolt (9) so as to form a multi-way valve for controlling the supply of fluid to, and its discharge from, the space between the Inner and outer bodies (10, 11) to adjust their relative angular positions, and a check valve (30) arranged in a fluid supply passage(50, 50', 53, 53') for the admission of the hydraulic fluid to the multi-way valve (3) and, respectively, the camshaft adjustment control device (1), said pressurized fluid supply passage (53) extending co-axially with the control spool valve (8) and the check valve (30) being arranged in the co-axially extending supply passage for supplying pressurized fluid to the control spool valve (8).

2. A camshaft adjustment control device according to claim 1, wherein the check valve (30, 30') has an opening pressure of 0 to 0.3 bar.

3. A camshaft adjustment control according to claim 1, wherein the pressurized fluid supply line (53) extends through the camshaft (2) and the check valve (30) is arranged in the pressurized fuel supply line extending through the camshaft (2).

4. A camshaft adjustment control according to claim 1, wherein the clamping screw (9) includes a central axial fluid supply bore (53, 53') in which the control spool (8) Is axially movably supported and the check valve (30) is disposed in the central axial bore (53).

5. A camshaft adjustment control according to claim 1, wherein said check valve (30, 30') comprises a blocking element (54) of one of steel and a ceramic material.

6. A camshaft adjustment control device according to claim 1, wherein the clamping bolt (9) has an axial bore (14) in which the control valve spool (8) is axially movably supported and a control magnet (5) is provided for axially moving the control valve spool (8) against the force of a spring (15) into different axial control positions.

7. A camshaft adjustment control device according to claim 1, wherein the blocking element (54) is subjected in the closing direction to a radial flow.

* * * * *